US005983820A

United States Patent [19]

Whitley

[11] Patent Number: 5,983,820

[45] Date of Patent: Nov. 16, 1999

[54] RETRACTABLE CLEAT

[75] Inventor: Warwick M. Whitley, McAllen, Tex.

[73] Assignee: Attwood Corporation, Lowell, Mich.

[21] Appl. No.: 09/185,148

[22] Filed: Nov. 3, 1998

[51] Int. Cl.[6] ..... B63B 21/04

[52] U.S. Cl. ..... 114/218

[58] Field of Search ..... 114/218; 440/106, 440/108, 109; D8/356

[56] References Cited

U.S. PATENT DOCUMENTS

| | | |
|---|---|---|
| D. 183,739 | 10/1958 | Gomersall . |
| 243,374 | 6/1881 | Howard et al. . |
| D. 376,752 | 12/1996 | Benveniste . |
| 515,818 | 3/1894 | Cline . |
| 757,882 | 4/1904 | Butterworth . |
| 1,299,529 | 4/1919 | Young . |
| 1,868,580 | 7/1932 | McKinney . |
| 2,045,083 | 6/1936 | Illig . |
| 2,077,629 | 4/1937 | Lahr . |
| 2,427,386 | 9/1947 | Claud-Mantle . |
| 2,783,494 | 3/1957 | Sterling et al. . |
| 2,870,733 | 1/1959 | Winther . |
| 3,042,161 | 7/1962 | Meyer, Jr. . |
| 3,074,750 | 1/1963 | Craig et al. . |
| 3,102,708 | 9/1963 | Crain . |
| 3,111,833 | 11/1963 | Dettmer . |
| 3,126,859 | 3/1964 | Bigelow . |
| 3,234,765 | 2/1966 | Kerr . |
| 3,257,971 | 6/1966 | Swendsen . |
| 3,524,413 | 8/1970 | Veasman . |
| 3,747,554 | 7/1973 | Allen . |
| 3,915,485 | 10/1975 | Richman et al. . |
| 3,917,213 | 11/1975 | Poehlmann . |
| 4,254,909 | 3/1981 | Rex . |
| 4,270,478 | 6/1981 | Kafka et al. . |
| 4,278,042 | 7/1981 | Lindquist . |
| 4,331,096 | 5/1982 | Lovejoy . |
| 4,350,108 | 9/1982 | Vall . |
| 4,354,445 | 10/1982 | Kafka et al. . |

(List continued on next page.)

FOREIGN PATENT DOCUMENTS 635569 11/1997 Germany .

OTHER PUBLICATIONS

Photographs of ABI Lift Up Cleat (4 each) by A & B Industries Incorporated of Petaluma, California dated at least as early as Mar. 1998.

Osculati brochure dated at least as early as 1993, 3 pages.

"ABI Lift Up Cleat" brochure by A & B Industries Incorporated of Petaluma, California, dated at least as early as Mar. 1998, (1 page).

"Flush Mounted Pop–Up Cleat" brochure by Accon Marine, Inc. of Clearwater, Florida, dated at least as early as Mar. 1998, (4 pages).

U.S. Trademark Registration No. 1,937,562 on Marine Fittings in the name of Accon, Inc. of Clearwater, Florida, registered Nov. 21, 1995, (1 page).

*Primary Examiner*—Stephen Avila

*Attorney, Agent, or Firm*—Price, Heneveld, Cooper, DeWitt & Litton

[57] ABSTRACT

A retractable cleat for recreational boats and the like includes a seal to inhibit moisture from entering the interior of the cleat. The retractable cleat has a base member, a retractable cleat member and seal positioned therebetween. The base has an upper plate for mounting on an associated boat surface, and a tube depending therefrom. The tube has a hollow interior with a stepped-shaped seat disposed adjacent to an uppermost end thereof. The retractable cleat member has an upper cleat-shaped head and a post depending therefrom. The post is telescopingly received into the interior of the base tube. The seal has an exterior surface thereof closely received in the base seat, and an interior surface closely receiving the cleat post therein. The resilient seal is configured to permit the post to slide longitudinally when the retractable cleat is shifted between a raised use position and a lowered storage position, and forms a watertight seal about the post to inhibit water from seeping into the base.

26 Claims, 2 Drawing Sheets

U.S. PATENT DOCUMENTS 4,453,486 6/1984 Harken .
4,457,650 7/1984 Tseng .
4,527,821 7/1985 Tanaka .
4,603,649 8/1986 Hystad .
4,672,909 6/1987 Sweetsir .
4,689,976 9/1987 Larsen .
4,696,916 9/1987 Weinerman et al. .
4,809,634 3/1989 Czipri .
4,890,566 1/1990 Morris .
4,921,258 5/1990 Fournier et al. .
4,945,849 8/1990 Morris et al. .
4,966,018 10/1990 Hauber .
5,004,388 4/1991 Harris .
5,058,907 10/1991 Percebois et al. .
5,106,248 4/1992 Harris .
5,301,627 4/1994 Czipri .
5,327,844 7/1994 Kress .
5,442,976 8/1995 Cheng .
5,477,800 12/1995 Lawrence .
5,477,801 12/1995 Lawrence .
5,507,505 4/1996 von-Arndt et al. .
5,519,959 5/1996 Cross .
5,520,134 5/1996 Walker .
5,535,694 7/1996 Czipri .
5,598,803 2/1997 Czipri ..... 114/218
5,826,531 10/1998 Havnaer ..... 114/218

RETRACTABLE CLEAT

BACKGROUND OF THE INVENTION

The present invention relates to cleats for recreational boats and the like, and in particular to a retractable cleat which incorporates a seal that prevents water from seeping into the interior of the retractable cleat.

Retractable cleats are widely used within recreational boats for securing mooring lines and the like thereto. These retractable cleats typically include a base member, and a retractable cleat member that is telescopingly received within the interior of the base.

Heretofore, retractable cleats have generally been constructed such that the mounting post portion of the retractable cleat fits rather loosely within the associated base. This loose fitting connection can allow water to seep into the base, and collect at the bottom thereof, thus causing corrosion of the base as well as the posts. The corrosion of the retractable cleat and base members often result in an unattractive overall appearance, and can hinder proper operation of the retractable cleat itself.

SUMMARY OF THE INVENTION

One aspect of the present invention is to provide a retractable cleat that includes a base member and a retractable cleat member. The base member has an upper plate shaped to be mounted on an associated boat surface, and a centrally disposed, vertically oriented tube depending from the upper plate. The tube has a hollow interior with a stepped-shaped seat disposed adjacent to the uppermost end of the tube. The retractable cleat member has an upper cleat-shaped head shaped to secure mooring lines and the like thereon, and a centrally disposed, vertically oriented mounting post depending from the head. The post of the cleat member is telescopingly received in the interior of the tube of the base member. The retractable cleat further includes an annularly-shaped seal having an exterior surface thereof closely received within the seat in the base member, and an interior surface thereof closely receiving the post of the cleat member therein. The resilient seal is configured to permit the post to slide longitudinally when the cleat member is shifted between a raised use position and a lowered storage position, and forms a watertight seal about the post to inhibit water from seeping into the tube of the base member.

The addition of the seal about the post of the cleat inhibits water from seeping into the tube of the base member, thereby reducing possible corrosion, discoloration and blemishing of the components of the retractable cleat apparatus that may hinder operation thereof.

These and other features, advantages and objects of the present invention will be further understood and appreciated by those skilled in the art by reference to the following specification, claims and appended drawings.

DETAILED DESCRIPTION OF PREFERRED EMBODIMENT

Figure 1:
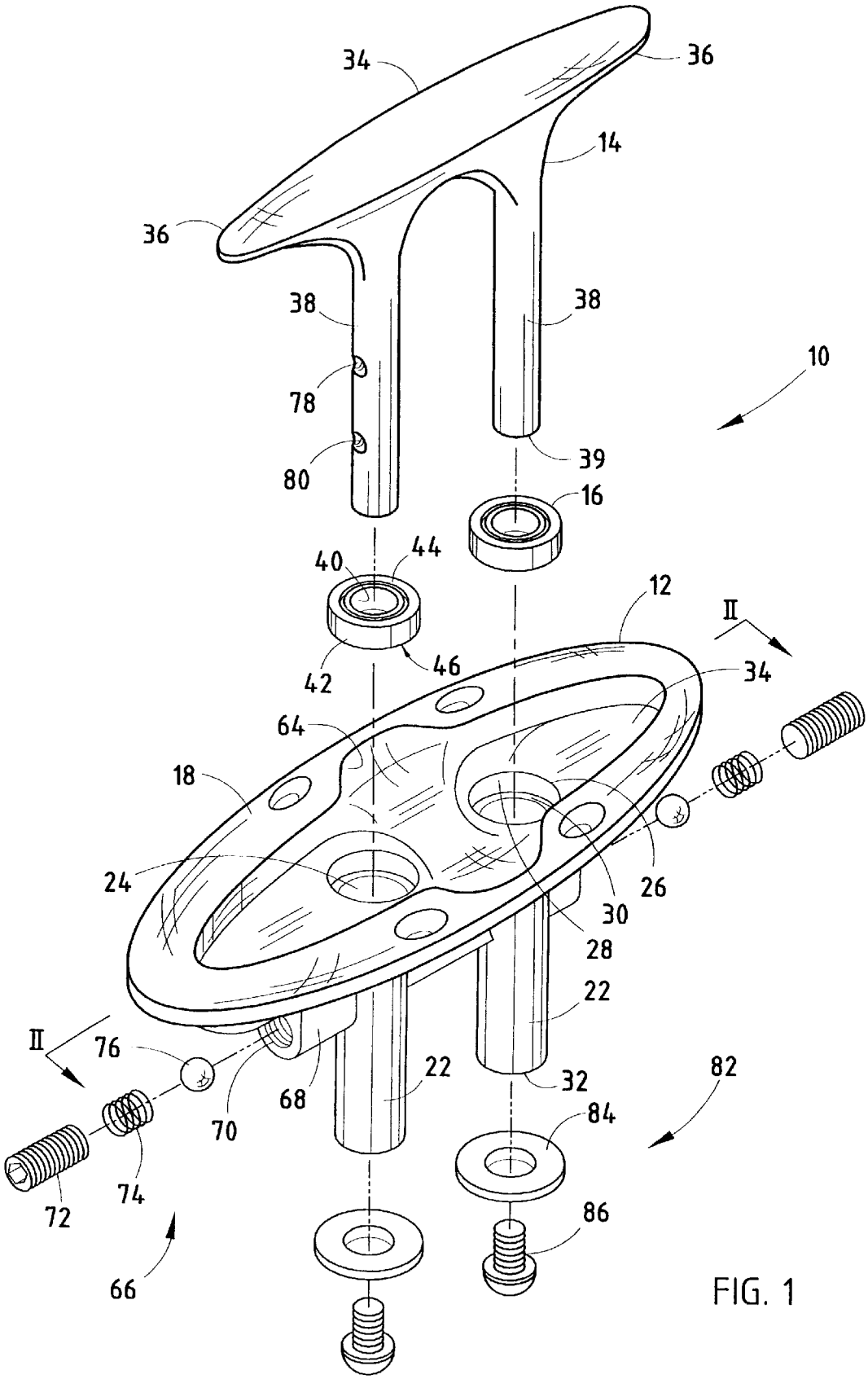
FIG. 1 is an exploded, perspective view of a retractable cleat embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 10 (FIG. 1) generally designates a retractable cleat embodying the present invention. Retractable cleat 10 includes a base member 12, a retractable cleat member 14, and at least one annularly-shaped seal 16.

Figure 2:
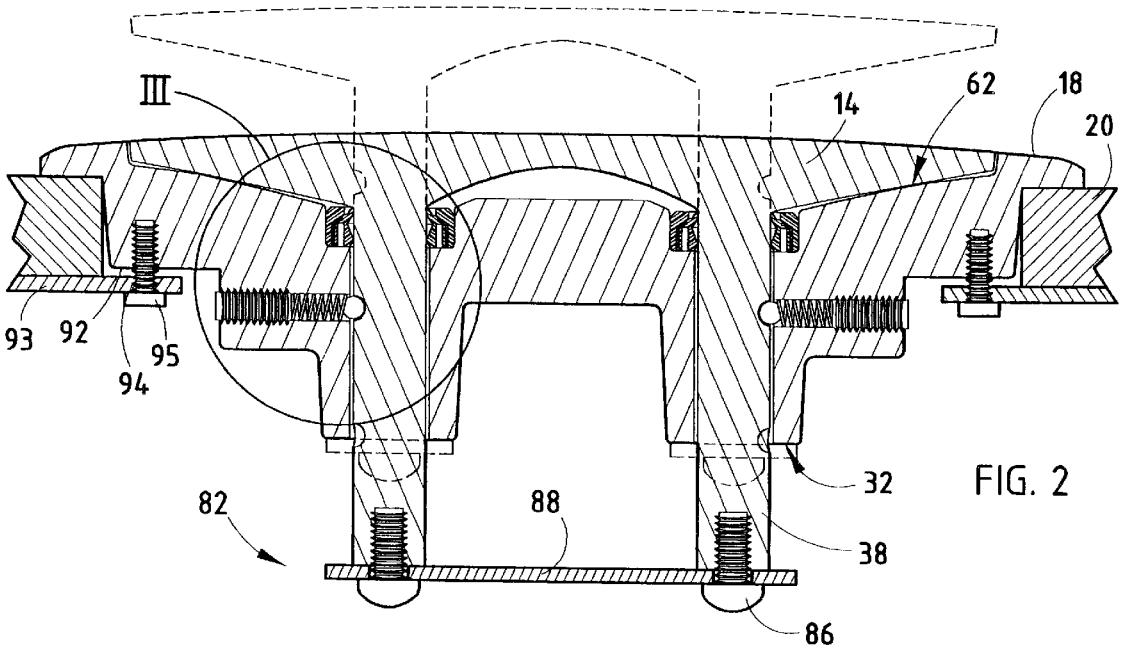
FIG. 2 is a vertical cross-sectional view of the retractable cleat, taken along the line II—II, FIG. 1, wherein a raised used condition is shown in broken lines.

The illustrated base member 12 is constructed of steel, aluminum or other suitable material, and includes an upper plate 18 shaped to be mounted on an associated boat surface 20 (FIG. 2), and a pair of centrally disposed, vertically oriented tubes 22 that depend from upper plate 18. Upper plate 18 has a generally oval shape, however, it is foreseeable that various alternative shapes may be used. Each tube 22 has a hollow interior defined by interior walls 24, and stepped-shaped seats 26 defined by interior walls 28 and step walls 30 disposed adjacent the uppermost ends of tubes 22. Each tube 22 has a generally cylindrical shape, with a lower or distal end 32.

Retractable cleat member 14 is provided with an upper cleat-shaped head 34 having outwardly disposed flanged ends 36. Head 34 has generally oval shape, however, it is foreseeable that alternative shapes may be used. The flanged ends 36 of cleat head 34 extend sufficiently outward, so as to allow mooring or retention lines associated with various objects within the boat or casting lines from a dock to be secured thereon. Retractable cleat member 14 is further provided with a pair of centrally disposed, vertically oriented mounting posts 38 that depend downwardly from the cleat head 34. The illustrated posts 38 are generally cylindrical in shape, and have a lower or distal end 39.

Each seal 16 is preferably constructed of a flexible resilient material, such as rubber, synthetic resins, etc. Each seal 16 has an interior surface 40, an exterior surface 42, a top surface 44, and a bottom surface 46.

Figure 3:
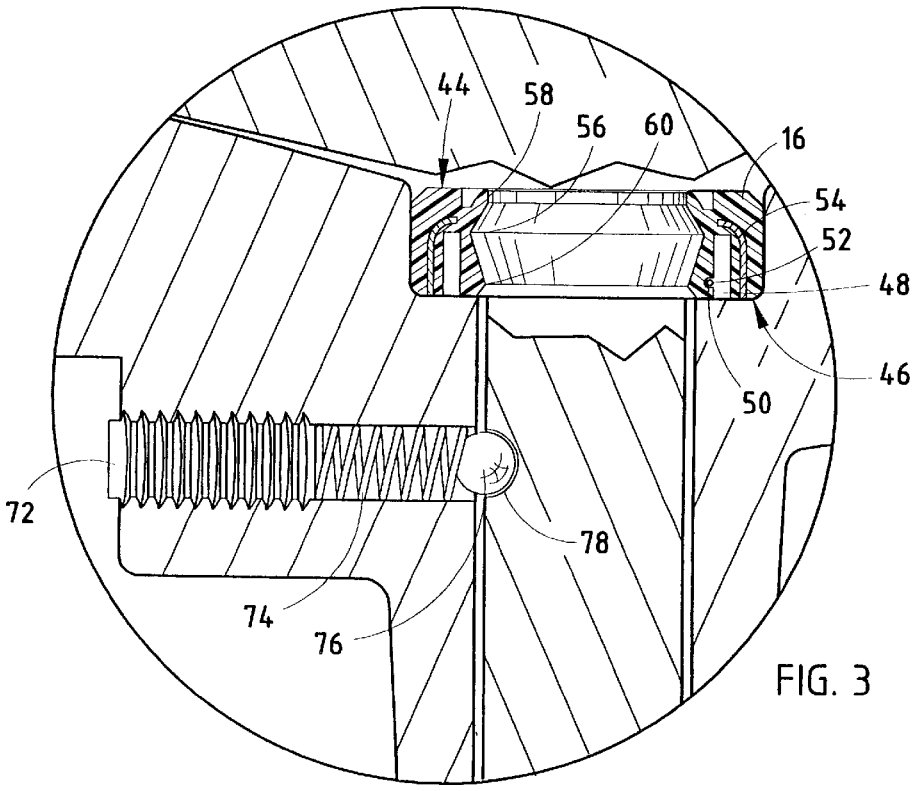
FIG. 3 is an enlarged, cross-sectional view of the retractable cleat apparatus, taken of the area III, FIG. 1, including a fragmentary cross-sectional view of a seal.

In assembly, seals 16 (FIGS. 1 and 3) are press-fit within the seats 26, such that the exterior surface 42 and bottom surface 46 of each seal 16 is in substantial contact with the interior wall 28 and step wall 30 of each seat 26, respectively. The mounting posts 38 of the retractable cleat 14 are telescopingly received within the interior of the tubes 22 of the base 12. The interior surface 40 of each seal 16 closely receives one of the posts 38 of the retractable cleat 14 therein. Each seal 16 is configured to permit the associated post 38 to slide longitudinally when the retractable cleat 14 is shifted between a raised use position, as shown by the broken lines in FIG. 2, and a lowered storage position, as shown by the full lines in FIG. 2, and forms a water resistant seal about each post 38 to inhibit water from seeping into the tubes 22 of the base 12.

In the illustrated retractable cleat 10, tubes 22, posts 38, and seals 16 all have a generally circular cross-sectional shape. However, it is to be understood that other cross-sectional shapes could be used to form the tubes 22 and the posts 38, and that the cross-sectional shape of the seals 16 could be configured similarly, so long as the seals 16 form an annular or marginal seal about exterior surface 42 of the posts 38, and interior surface 40 of each seal 16 is in close contact with the interior walls 28 of its associated seat 26.

In the illustrated example, each seal 16 is provided with a channel 48 (FIG. 3) that extends upwardly from bottom surface 46, and a spring seating channel 50 extending radially inwardly from channel 48. A circular spring 52 is positioned within spring seating channel 50, such that the interior surface 40 of each seal 16 is biased radially inwardly towards each post 38 to create a tight sliding fit between each seal 16 and its associated post 38. Each seal 16 is further provided with an inmolded steel band 54 extending circumferentially about each seal 16. The steel bands 54 reinforce the structural rigidity of the seals 16, and resist the radially inwardly biasing force of the springs 52, thus creating a tight fit between the exterior surface 42 of each seal 16 and the interior wall 28 of each step 30 of base 12.

The interior surface 40 (FIG. 3) of each seal 16 is tapered, with a circumferentially outwardly extending center area 56, thus creating an upper radial contact point or rim 58, and a lower radial contact point or rim 60 along interior surface 40.

The base 12 (FIGS. 1 and 2) is further provided with a cleat head recess 62, finger recesses 64, and positive engagement assemblies 66. Cleat head recess 62 is generally oval-shaped and is configured so as to allow the cleat head 34 of the retractable cleat 14 to be received and seat therein, such that cleat head 34 is substantially flush with the upper plate 18 of the base 12 when retractable cleat 14 is in the lowered storage position shown by the full lines in FIG. 2. Finger recesses 64 extend outwardly from the cleat head recess 62 within upper plate 18, and are sufficiently large enough for the operator of the retractable cleat 10 to insert their fingers within the finger recesses 64, thus grasping the sides of cleat head 34 and allowing the operator to raise retractable cleat member 14 from the lowered storage position to the raised use position.

The illustrated positive engagement assemblies 66 (FIGS. 1–3) each include a laterally extending channel 68 formed within the base 12 adjacent to the tubes 22. Each channel 68 is provided with a threaded distal end 70. A set screw 72 is threadably engaged within the distal end 70 of each channel 68. A biasing spring 74 is disposed within each channel 68, and inwardly biases a ball bearing 76, such that the bearings 76 are in substantial contact with the posts 38 of the retractable cleat 14. Each post 38 of retractable cleat 14 is provided with an inwardly facing upper dimple 78, and an inwardly facing lower dimple 80. The upper dimples 78 are located along posts 38, such that the ball bearings 76 are engaged within the upper dimples 78, thus holding retractable cleat 14 bearings in the lowered storage position. The force exerted by the ball bearings 76 inserted within the upper dimples 78 can be overcome by the operator applying upward force to the retractable cleat 14, thus forcing ball bearings 76 to disengage dimples 78 and recede within channels 68. Lower dimples 80 are positioned along posts 38, such that ball bearings 76 are engaged within lower dimples 80 when retractable cleat 14 is in the raised use position. The force exerted by ball bearings 76 within lower dimples 80 can be overcome by the operator applying downward pressure upon retractable cleat 14, thus forcing ball bearings 76 to disengage dimples 80, and recede within channels 68 for returning the retractable cleat 14 to its lowered storage position.

Retractable cleat 10 is further provided with a positive stop assembly 82. The illustrated positive stop assembly 82 includes a pair of cylindrical washers 84 and a pair of screws 86. Each washer 84 is held in close contact with the distal end 39 of each post 38 by screws 86 which are threadably engaged within the distal ends 39 of posts 38. Washers 84 have a sufficient outer diameter such that they restrict telescopic travel of posts 38 within tubes 22 when washers 84 contact the distal ends 32 of tubes 22.

In an alternative embodiment of the present invention, the positive stop assembly 82 (FIG. 2) includes a rectangularly-shaped bar 88 and a pair of screws 86. Bar 88 is assembled with the posts 38 of retractable cleat 14 in a fashion similar to the washers 84 (FIG. 1) of the previous embodiment. Bar 88 restricts telescopic travel of posts 38 within tubes 22 when bar 88 contacts the distal ends 32 of tubes 22.

The upper plate 18 (FIG. 1) of base 12 is provided with a plurality of mounting apertures 90. Retractable cleat 10 can be fastened on or within a boat surface 20 by mounting mechanical fasteners, such as bolts or screws, within the apertures 90 of upper plate 18.

In an alternative embodiment of the present invention, the upper plate 18 (FIG. 2) of base 12 is provided with a plurality of upwardly projecting threaded apertures 92. Backing plates 93 are fixedly attached to and extend outwardly from boat surface 20. Backing plates 93 are provided with a plurality of mounting apertures 94. The base 12 is secured within the boat surface 20 by a plurality of bolts 95 engaged through mounting apertures 94 of backing plates 93 and threadably engaged within threaded apertures 92 of upper plate 18.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A retractable cleat for boats and the like, comprising:

a base member having an upper plate shaped to be mounted on an associated boat surface, and a centrally disposed, normally vertically oriented tube depending from said plate, said tube having a hollow interior with a stepped-shaped seat disposed adjacent an uppermost end thereof;

a retractable cleat member having an upper cleat-shaped head shaped to retain lines thereon, and a centrally disposed, normally vertically oriented mounting post depending from said head, and telescopingly received in the interior of said tube of said base member; and an annularly shaped seal having an exterior surface thereof closely received in said seat in said base member, and an interior surface thereof closely receiving said post of said cleat member therein, and being configured to permit said post to slide longitudinally when said cleat member is shifted between a raised use position and a lowered storage position, and form a watertight seal about said post to inhibit water from seeping into said tube of said base member.

2. A retractable cleat as set forth in claim 1, wherein:

said post has a generally cylindrical shape; and said interior surface of said seal has a circular plan shape which mates closely with the cylindrical shape of said post.

3. A retractable cleat as set forth in claim 2, wherein:

said seal is constructed from a flexible resilient material.

4. A retractable cleat as set forth in claim 3, wherein:

said seal includes a circumferentially extending spring which biases said interior surface of said seal radially inwardly to create a tight sliding fit with said post.

5. A retractable cleat as set forth in claim 4, wherein:

said seal includes a circumferentially extending steel band which reinforces the structural rigidity of said exterior surface of said seal thereby creating a tight fit between said seal and said seat of said base member.

6. A retractable cleat as set forth in claim 5, wherein:

said base member includes a centrally disposed recess adjacent said upper plate which is shaped to receive said head of said cleat member therein, such that when said cleat member is in said lowered storage position, said head is substantially flush with said upper plate to avoid obstructing the boat surface.

7. A retractable cleat as set forth in claim 6, including:

a first inwardly facing dimple disposed in said post;

a channel formed adjacent to said tube;

a set screw threadably engaged in said channel;

a spring disposed in said channel; and a ball bearing biased outwardly by said spring into engagement within said first dimple, such that said ball bearing is engaged within said first dimple when said cleat member is in said raised use position.

8. A retractable cleat as set forth in claim 7, wherein:

said post is provided with a second inwardly facing dimple, such that said ball bearing is engaged within said second dimple when said cleat member is in said lowered storage position.

9. A retractable cleat as set forth in claim 8, including:

a washer is connected with a lowermost end of said post and restricting telescopic travel of said post within said tube when said washer contacts an adjacent end of said tube.

10. A retractable cleat as set forth in claim 9, wherein:

said base includes two of said vertically oriented tubes disposed in a laterally spaced-apart relationship;

said cleat includes two of said vertically oriented mounting posts disposed in a laterally spaced-apart relationship for alignment with said tubes; and two of said seals received within an associated one of said seats in said base, and closely receiving one of said posts of said cleat member therein.

11. A retractable cleat as set forth in claim 10, including:

a pair of bolts threadably engaged within associated ends of said posts to connect said washer thereto.

12. A retractable cleat as set forth in claim 10, wherein:

a plate is held in contact with a lower end of said posts by bolts threadably engaged with said ends of said posts, said plate restricting telescopic travel of said posts within said tubes when said plate contacts said lower end of said tubes.

13. A retractable cleat as set forth in claim 12, wherein:

said upper plate of said base includes a plurality of apertures, said base secured within said boat surface by a plurality of mechanical fasteners extending through said apertures.

14. A retractable cleat as set forth in claim 12, wherein:

at least one backing plate is secured to said boat surface, said at least one backing plate having a plurality of apertures; and said upper plate of said base includes a plurality of downwardly exposed threaded apertures, said base secured within said boat surface by a plurality of mechanical fasteners extending through said plurality of apertures of said at least one backing plate and threadably engaged within said plurality of threaded apertures of said plate.

15. A retractable cleat as set forth in claim 1, wherein:

said seal is constructed from a flexible resilient material.

16. A retractable cleat as set forth in claim 1, wherein:

said seal includes a circumferentially extending spring which biases said interior surface of said seal radially inwardly to create a tight sliding fit with said post.

17. A retractable cleat as set forth in claim 16, wherein:

said seal includes a circumferentially extending steel band which reinforces the structural rigidity of said exterior surface of said seal thereby creating a tight fit between said seal and said seat of said base member.

18. A retractable cleat as set forth in claim 1, wherein:

said base member includes a centrally disposed recess adjacent said upper plate which is shaped to receive said head of said cleat member therein, such that when said cleat member is in said lowered storage position, said head is substantially flush with said upper plate to avoid obstructing the boat surface.

19. A retractable cleat as set forth in claim 1, including:

a first inwardly facing dimple disposed in said post;

a channel formed adjacent to said tube;

a set screw threadably engaged in said channel;

a spring disposed in said channel; and a ball bearing biased outwardly by said spring into engagement within said first dimple, such that said ball bearing is engaged within said first dimple when said cleat member is in said raised use position.

20. A retractable cleat as set forth in claim 1, including:

a washer connected with a lowermost end of said post and restricting telescopic travel of said post within said tube when said washer contacts an adjacent end of said tube.

21. A retractable cleat as set forth in claim 1, wherein:

said base includes two of said vertically oriented tubes disposed in a laterally spaced-apart relationship;

said cleat includes two of said vertically oriented mounting posts disposed in a laterally spaced-apart relationship for alignment with said tubes; and including two of said seals received within an associated one of said seats in said base, and closely receiving one of said posts of said cleat member therein.

22. A retractable cleat for boats and the like, comprising:

a base member having an upper plate shaped to be mounted on an associated boat surface, and a generally ovate top plan shape, and a pair of centrally disposed, normally vertically oriented tubes depending from said plate in a laterally spaced-apart relationship; said tubes having hollow interiors with stepped-shaped seats disposed adjacent uppermost ends thereof;

a retractable cleat member having an upper cleat-shaped head shaped to retain lines thereon, and a pair of centrally disposed, normally vertically oriented mounting posts depending from said head, and telescopingly received in the interior of said tubes of said base member; and a pair of annularly shaped seals having exterior surfaces thereof closely received in said seats in said base member, and interior surfaces thereof closely receiving said posts of said cleat member therein, and being configured to permit said posts to slide longitudinally when said cleat member is shifted between a raised use position and a lowered storage position, and form a watertight seal about said posts to inhibit water from seeping into said tubes of said base member.

23. A retractable cleat as set forth in claim 22, wherein:

said posts have a generally cylindrical shape; and said interior surfaces of said seals have a circular plan shape which mates closely with the cylindrical shape of said posts.

24. A retractable cleat as set forth in claim 22, wherein:

said seals include circumferentially extending springs which bias said interior surfaces of said seals radially inwardly to create a tight sliding fit with said posts.

25. A retractable cleat as set forth in claim 22, wherein:

said seals include circumferentially extending steel bands which reinforce the structural rigidity of said exterior surfaces of said seals thereby creating a tight fit between said seals and said seats of said base member.

26. A retractable cleat as set forth in claim 22, wherein:

said base member includes a centrally disposed recess adjacent said upper plate which is shaped to receive said head of said cleat member therein, such that when said cleat member is in said lowered storage position, said head is substantially flush with said upper plate to avoid obstructing the boat surface.

* * * * *